US009972905B2

(12) United States Patent
Schaffner et al.

(10) Patent No.: US 9,972,905 B2
(45) Date of Patent: May 15, 2018

(54) RECONFIGURABLE ELECTROMAGNETIC SURFACE OF PIXELATED METAL PATCHES

(71) Applicant: HRL LABORATORIES LLC, Malibu, CA (US)

(72) Inventors: James H. Schaffner, Chatsworth, CA (US); Hyok J. Song, Oak Park, CA (US); Keyvan R. Sayyah, Santa Monica, CA (US); Pamela R. Patterson, Los Angeles, CA (US); Jeong-Sun Moon, Moorpark, CA (US); Alan E. Reamon, Woodland Hills, CA (US); Keerti S. Kona, Woodland Hills, CA (US); Joseph S. Colburn, Malibu, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days. days.

(21) Appl. No.: 14/617,361

(22) Filed: Feb. 9, 2015

(65) Prior Publication Data

US 2016/0013549 A1 Jan. 14, 2016

Related U.S. Application Data

(60) Provisional application No. 61/940,070, filed on Feb. 14, 2014.

(51) Int. Cl.
*H01Q 3/01* (2006.01)
*H01Q 1/06* (2006.01)
(Continued)

(52) U.S. Cl.
CPC ..... *H01Q 3/01* (2013.01); *H01Q 1/06* (2013.01); *H01Q 3/46* (2013.01); *H01Q 9/0407* (2013.01);
(Continued)

(58) Field of Classification Search
CPC ..... H01Q 3/01; H01Q 3/2676; H01Q 21/065
See application file for complete search history.

(56) References Cited

U.S. PATENT DOCUMENTS 5,105,200 A 4/1992 Koepf
5,294,939 A 3/1994 Sanford et al.
(Continued)

FOREIGN PATENT DOCUMENTS

CN 102820540 A 12/2012
EP 1738209 1/2007
WO 02/23671 3/2002

OTHER PUBLICATIONS

International Search Report and Written Opinion (ISR & WO) from PCT/US2015/015966 dated Dec. 9, 2015.
(Continued)

*Primary Examiner* — Daniel J Munoz
(74) *Attorney, Agent, or Firm* — Ladas & Parry

(57) ABSTRACT

A reconfigurable electro-magnetic tile includes a laser layer including a plurality of lasers, and a pixelated surface comprising a plurality of metal patches and a plurality of switches, wherein each respective switch of the plurality of switches is in a gap between a first respective metal patch and a second respective metal patch, wherein each respective switch is optically coupled to at least one respective laser of the plurality of lasers, and wherein each switch of the plurality of switches comprises a phase change material.

29 Claims, 12 Drawing Sheets

(51) Int. Cl.

| | |
|---|---|
| ***H01Q 9/04*** | (2006.01) |
| ***H01Q 21/00*** | (2006.01) |
| ***H01Q 21/06*** | (2006.01) |
| ***H01Q 3/46*** | (2006.01) |
| ***H01Q 19/00*** | (2006.01) |
| ***H01Q 3/26*** | (2006.01) |

(52) U.S. Cl.
CPC ..... *H01Q 19/005* (2013.01); *H01Q 21/0093* (2013.01); *H01Q 21/065* (2013.01); *H01Q 3/2676* (2013.01)

(56) References Cited

U.S. PATENT DOCUMENTS

| | | | | |
|---|---|---|---|---|
| 5,619,365 | A * | 4/1997 | Rhoads | B82Y 20/00 359/248 |
| 5,923,291 | A * | 7/1999 | Page | H01Q 3/2676 342/368 |
| 6,005,519 | A | 12/1999 | Burns | |
| 6,078,288 | A * | 6/2000 | Adams | B60T 7/042 342/372 |
| 6,198,438 | B1 | 3/2001 | Herd et al. | |
| 6,218,990 | B1 * | 4/2001 | Grangeat | H01Q 9/0421 343/700 MS |
| 6,388,631 | B1 | 5/2002 | Livingston et al. | |
| 7,068,234 | B2 | 6/2006 | Sievenpiper | |
| 7,965,249 | B1 | 6/2011 | Wolf et al. | |
| 8,009,115 | B2 | 8/2011 | Walton et al. | |
| 2002/0003497 | A1 | 1/2002 | Gilbert et al. | |
| 2002/0101391 | A1 * | 8/2002 | Kanamaluru, Sr. | H01Q 1/38 343/915 |
| 2003/0036750 | A1 | 2/2003 | Ruiz et al. | |
| 2004/0201526 | A1 | 10/2004 | Knowles et al. | |
| 2004/0263420 | A1 | 12/2004 | Werner et al. | |
| 2005/0237237 | A1 | 10/2005 | Lust et al. | |
| 2005/0237267 | A1 | 10/2005 | Brown et al. | |
| 2007/0180338 | A1 * | 8/2007 | Becker | H01Q 3/2676 714/724 |
| 2008/0029753 | A1 | 2/2008 | Xu et al. | |
| 2008/0297194 | A1 | 12/2008 | Zeng et al. | |
| 2009/0309799 | A1 | 12/2009 | Hossain | |
| 2011/0095958 | A1 | 4/2011 | Mao et al. | |
| 2012/0162010 | A1 | 6/2012 | Georgiadis et al. | |
| 2013/0176177 | A1 | 7/2013 | Cetiner et al. | |
| 2015/0236408 | A1 | 8/2015 | Kona et al. | |

OTHER PUBLICATIONS

Chua et al., "Low Resistance, High Dynamic Range Reconfigurable Phase Change Switch for Rf Applications", Applied Physics Letters, vol. 97, 183506, 2010.
Lo et al., "Three-Terminal Probe Reconfigurable Phase-Change Material Switches", IEEE Transactions on Electron Devices, vol. 57, No. 1, pp. 312-320, Jan. 2010.
Wen et al. "A Phase-Change-Via-Reconfigurable On-Chip Inductor", IEDM Tech Digest, pp. 10-237-10-240, 2010.
EE Times, Nov. 2011, "Samsung Preps 8-Gbit Phase-Change Memory".
Perniola et al. "Electrical Behavior of Phase-Change Memory Cells Based on GeTe", IEEE Electron Device Letters, vol. 31, No. 5, May 2010, pp. 488-490.
Li et al., "A New Class of Antenna Array With a Reconfigurable Element Factor", IEEE Transactions on Antennas and Propagation, vol. 61, No. 4, Apr. 2013, pp. 1947-1955.
Rodrigo et al., "Frequency and Radiation Pattern Reconfigurability of a Multi-Size Pixel Antenna", IEEE Transactions on Antennas and Propagation, vol. 60, No. 5, May 2012, pp. 2219-2225.
Besoli et al., "A Multifunctional Reconfigurable Pixelated Antenna Using MEMS Technology on Printed Circuit Board", Vo. 59, No. 12, Dec. 2011, pp. 4413-4424.
Su et al., A Numerically Efficient Transmission Characteristics Analysis of Finite Planar Frequency-Selective Surfaces Embedded in Stratified Medium, ICMMT 2010 Proceedings, pp. 152-155.
Phillips Media Relations, DVD+Rewritable—"How It Works", 1999, Eindhoven, The Netherlands.
D.J. Adelerhol et al., "Media Development for DVD+RW Phase Change Recording", Proc. European Symposium on Phase Change Material (epcos.org), 2004.
J.F. Seurin et al., "High Power VCSELs Mature Into Production", Laser Focus World, Apr. 2011, pp. 61-65.
J.K. Olsen et al., Optical Properties of Amorphous GeTe, SB 2 Te 3, and Ge 2 Te 5: The Role of Oxygen, Journal of Applied Physics, vol. 99, 103508, 2006.
Chu et al., Laser-Induced Phase Transitions of Ge2Sb2Te5 Thin Films Used in Optical and Electronic Data Storage and in Thermal Lithography, Optics Express, vol. 18, No. 17, Aug. 16, 2010, pp. 18383-18393.
M. Xu et al., "Pressure Tunes Electrical Resistivity by Four Orders of Magnitude in Amorphous Ge2Sb2Te5 Phase-Change Memory Alloy", Proceeding National Academy Science U.S.A, May 1, 2012, 109(18), pp. E1055-E1062.
From U.S. Appl. No. 13/737,441 (now U.S. Pat. No. 8,900,930) Notice of Allowance dated Jul. 31, 2014.
From U.S. Appl. No. 13/737,441 (now U.S. Pat. No. 8,900,930) Non-Final Office Action dated Jun. 4, 2014.
From U.S. Appl. No. 13/737,441 (now U.S. Pat. No. 8,900,930) Restriction Requirement dated Mar. 26, 2014.
J. Luther, S. Ebadi, and X. Gong in "A Microstrip Patch Electronically Steerable Parasitic Array Radiator (ESPAR) Antenna with Reactance-Tuned Coupling and Maintained Resonance," *IEEE Transactions on Antennas and Propagation*, vol. 60, No. 4, pp. 1803-1813, (Apr. 2012).
P.W. Hannan, D.S. Lerner, and G.H. Knittel in "Impedance Matching a Phased-Array Antenna Over Wide Scan Angles by Connecting Circuits," *IEEE Transactions on Antennas and Propagation*, vol. AP-13, pp. 28-34, (Jan. 1965).
International Search Report and Written Opinion (ISR & WO) from PCT Application No. PCT/US2015/015070, dated Nov. 19, 2015.
From U.S. Appl. No. 14/621, 907 (Now Published as 2015/0236408, Filed Feb. 13, 2015), Application and Office Actions.
From PCT Application No. PCT/US2015/015070, Chapter II, International Preliminary Report on Patentability (IPRP), dated Apr. 22, 2016.
2nd Written Opinion from PCT/US2015/015966 dated May 11, 2016.
From PCT Application No. PCT/US2015/015966, Chapter II, International Preliminary Report on Patentability (IPRP), dated Aug. 22, 2016.
From U.S. Appl. No. 14/621,907 (Now U.S. Publication No. 2015-0236408), Non-Final Rejection dated May 31, 2016.
From U.S. Appl. No. 14/621,907 (Now U.S. Publication No. 2015-0236408), Final Rejection dated Dec. 14, 2016.
From U.S. Appl. No. 14/621,907 (Now U.S. Publication No. 2015-0236408), Non-Final Office Action dated Jun. 19, 2017.
Extended European Search Report and Opinion for European Patent application No. 15796202.8 dated Oct. 27, 2017.
Extended European Search Report and Opinion for European Patent application No. 15783219.7 dated Nov. 20, 2017.
Haupt et al. "Reconfigurable Antennas." IEEE Antennas and Propagation Magazine, vol. 55, No. 1, Feb. 2013 (pp. 49-61).
Shim et al. "RF Switches Using Phase Change Materials". Micro Electro Mechanical Systems (MEMS). IEEE. Jan. 20, 2013. pp. 237-240.
Raoux et al. "Phase Change Materials: Science and Applications." Jan. 1, 2009. pp. iii-iv, ix-x.
R.E Hopkins: "The Components in the Basic 3 Optical Systems" In: Daniel Malacara: "Geometrical and Instrumental Optics". Dec. 1, 1988. vol. 25. p. iii-iv.vi.106. 1st paragraph. Section 3.6; p. 106.

* cited by examiner

RECONFIGURABLE ELECTROMAGNETIC SURFACE OF PIXELATED METAL PATCHES

CROSS REFERENCE TO RELATED APPLICATIONS

This application is related to U.S. patent application Ser. No. 13/737,441, filed Jan. 9, 2013, and is related to and claims priority to U.S. Provisional Patent Application Ser. No. 61/940,070, filed Feb. 14, 2014, which are incorporated herein as though set forth in full.

TECHNICAL FIELD

This disclosure relates to reconfigurable electro-magnetic (EM) apertures and in particular to pixelated reconfigurable antennas.

BACKGROUND

Reconfigurability of an electro-magnetic (EM) surface is often desired when a variety of RF functions are needed and there is a space or weight limitation at the location on which the electromagnetic structure is to be mounted. Reconfigurability of an EM surface can also save assembly time and material costs of having to swap out RF apertures when a new RF application is needed.

J. D. Wolfm N. P. Lower, L. M Paulsen, J. P. Doene, and J. B. West describe, in "Reconfigurable radio frequency (RF) surface with optical bias for RF antenna and RF circuit applications", U.S. Pat. No. 7,965,249, issued Jun. 21, 2011, a reconfigurable antenna with optical actuation of photoconductive switches between small metallic patches forming a pixelated surface. Light emitting diodes (LEDs) are used to actuate the photoconductive switches, which has the disadvantage of requiring constant power input to drive the LED's to keep the switches closed. In a large EM structure very high power would be required. Lacking in the description is any teaching on what happens to an RF feed when the antenna is reconfigured L. Zhouyuan, D. Rodrigo, L. Jofre, and B. A. Cetiner, in "A new class of antenna array with a reconfigurable element factor," *IEEE Trans. Antenna Propagation.*, Vol. 61, No. 4, April 2103, pp. 1947-1955 describe a reconfigurable element that uses a parasitic pixel array of small metallic patches which are reconfigured using switches to provide beam steering or polarization switching. A non-reconfigurable patch antenna is used as the driver for the parasitic pixels, which limits the bandwidth to the patch size.

Other examples of pixelated structures for reconfigurable antennas are described by E. K. Walton, and B. G. Montgomery, in "Reconfigurable antenna using addressable pixel pistons," U.S. Pat. No. 7,561,109, issued Jul. 14, 2009; E. Rodrigo and L. Jofre, in "Frequency and radiation pattern reconfigurability of a multi-size pixel antenna," IEEE Trans. Antenna Propagation., Vol. 60, No. 5, May 2012, pp. 2219-2225; and A. G. Besoli and F. De Flaviis, in "A multifunction reconfigurable pixeled antenna using MEMS Technology on printed circuit board," IEEE Trans. Antennas and Propagation, Vol. 59, No. 12, December 2011. However, all of these use mechanical or electronic switches which require a complicated and RF degrading direct current (DC) bias network.

What is needed is an improved reconfigurable electromagnetic surface. The embodiments of the present disclosure answer these and other needs.

SUMMARY

In a first embodiment disclosed herein, a reconfigurable electro-magnetic tile comprises a laser layer comprising a plurality of lasers, and a pixelated surface comprising a plurality of metal patches and a plurality of switches, wherein each respective switch of the plurality of switches is in a gap between a first respective metal patch and a second respective metal patch, wherein each respective switch is optically coupled to at least one respective laser of the plurality of lasers, wherein each switch of the plurality of switches comprises a phase change material, wherein the phase change material of a respective switch changes from a non-conducting state to a conducting state when the coupled respective laser lases a first power density of light on the phase change material of the respective switch, and wherein the phase change material of a respective switch changes from a conducting state to a non-conducting state when the coupled respective laser lases a second power density of light on the phase change material of the respective switch.

In another embodiment disclosed herein, a method of providing a reconfigurable electro-magnetic tile comprises providing a laser layer comprising a plurality of lasers, and providing a pixelated surface comprising a plurality of metal patches and a plurality of switches, wherein each respective switch of the plurality of switches is in a gap between a first respective metal patch and a second respective metal patch, wherein each respective switch is optically coupled to at least one respective laser of the plurality of lasers, wherein each switch of the plurality of switches comprises a phase change material, wherein the phase change material of a respective switch changes from a non-conducting state to a conducting state when the coupled respective laser lases a first power density of light on the phase change material of the respective switch, and wherein the phase change material of a respective switch changes from a conducting state to a non-conducting state when the coupled respective laser lases a second power density of light on the phase change material of the respective switch.

These and other features and advantages will become further apparent from the detailed description and accompanying FIG.s that follow. In the FIG.s and description, numerals indicate the various features, like numerals referring to like features throughout both the drawings and the description.

BRIEF DESCRIPTION OF THE DRAWINGS

FIGS. 7A, 7B, 7C and 7D compare the RF performance for using DC bias lines for actuation of switches to using optical actuation of switches in accordance with the present disclosure;

DETAILED DESCRIPTION

In the following description, numerous specific details are set forth to clearly describe various specific embodiments disclosed herein. One skilled in the art, however, will understand that the presently claimed present disclosure may be practiced without all of the specific details discussed below. In other instances, well known features have not been described so as not to obscure the present disclosure.

Figures 1A, 1B:
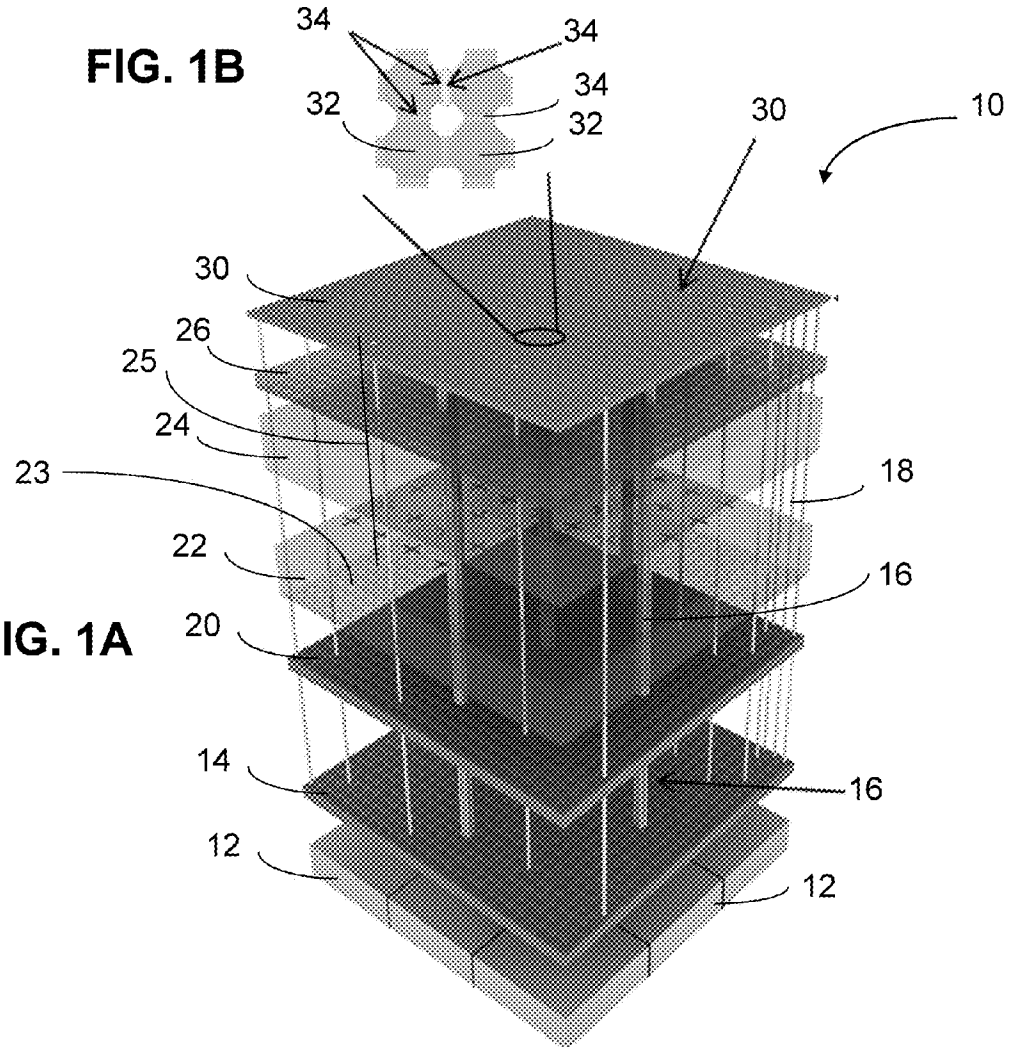
FIG. 1A shows a reconfigurable electromagnetic pixelated surface tile.
FIG. 1B shows a detail of switches between metal patches in accordance with the present disclosure.

The present disclosure describes an electromagnetic (EM) tile 10, as shown in FIG. 1A, whose top surface consists of a two dimensional periodic array of metal patches 32 separated by small gaps such that the period is much smaller than a wavelength at any frequency of interest. Within each gap between metal tiles 32 is a switch 34 which, when activated, electrically connects the two metal patches 32 that straddle the gap. Connection of various metal patches 32 through actuation of the switches 34 in the gaps between the metal patches effectively creates larger conductive structures which can form the basis of antennas, transmission line, and frequency selective surfaces. By selecting specific switches 34, electromagnetic structures can be configured, and then by changing states of the switches 34, reconfigured to another electromagnetic structure. The tile 10 can also be part of an array of tiles 10 to create larger electromagnetic structures. An individual tile 10 or an array of tiles can be reconfigured for a multitude of electromagnetic functions, such as frequency tuned transmit or receive arrays, beam steering, tuned frequency selective surfaces, and transmission line circuits for routing, filtering, and impedance matching. The small metal patches 32 and the switches 34 can be considered to make a pixelated reconfigurable electromagnetic surface. In this disclosure, the switches 34 are actuated using optical signals from lasers (light amplification by stimulated emission of radiation) in a vertical cavity surface emitting laser (VCSEL) array 14. The optically actuated switches 34 are preferably fabricated from Phase Change Material (PCM), because PCM is bi-stable and can be set into either a conductive or a non-conductive state. Once set, the optical actuation signal can be removed and the PCM will stay in the state to which it was set.

Figure 11:
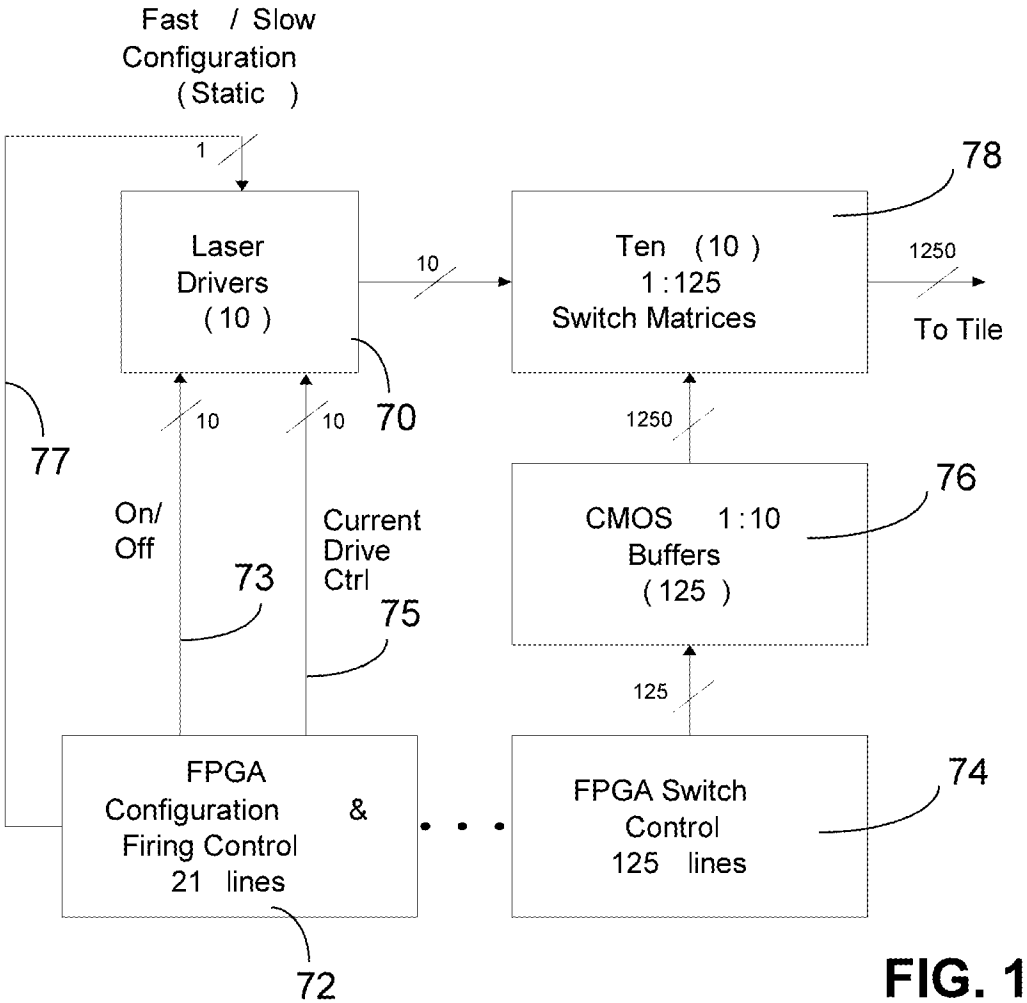
FIG. 11 shows an example of a control and driver network for 1250 VCSELS in accordance with the present disclosure.
Figure 12:
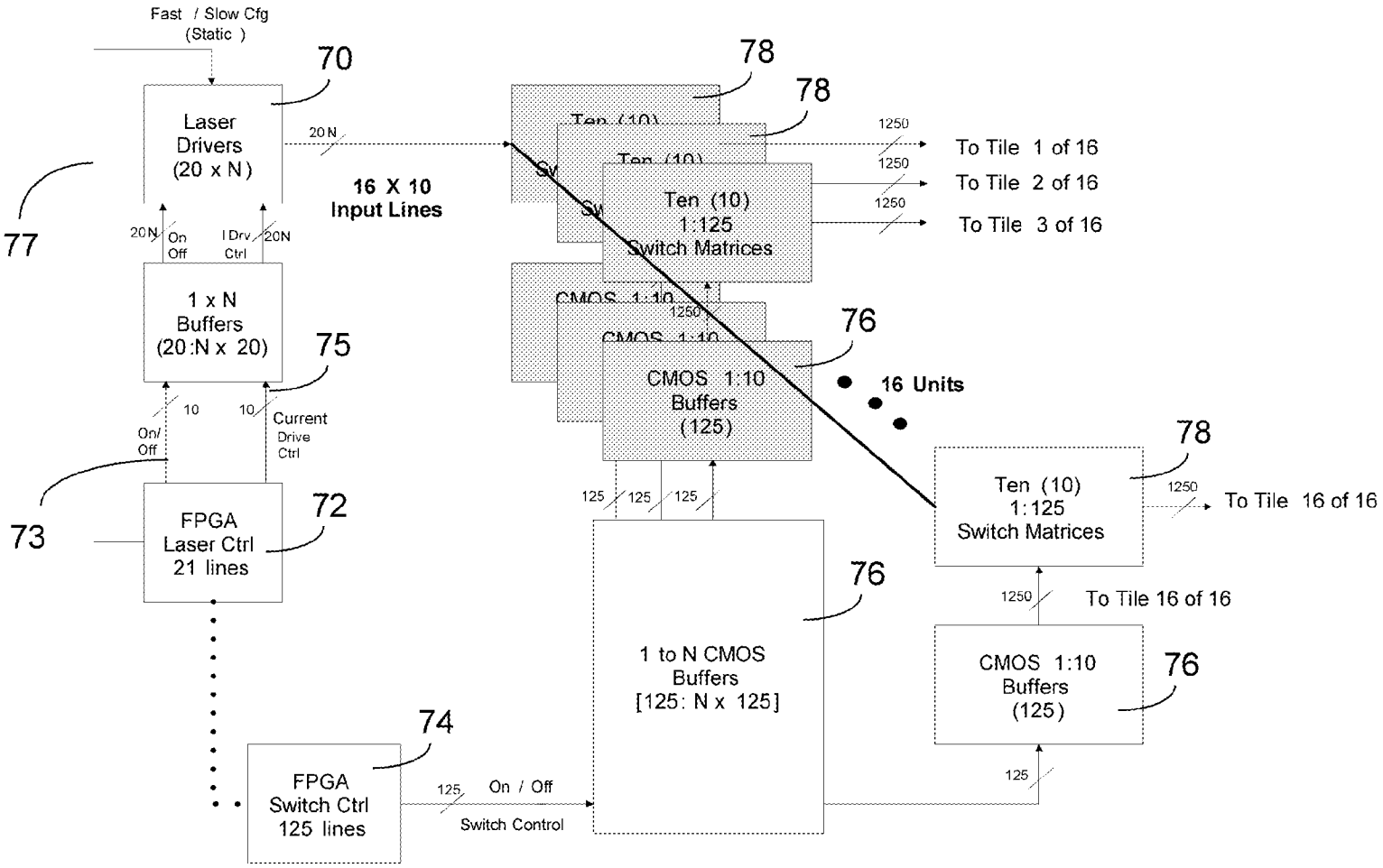
FIG. 12 shows an example of an extension of the control/driver network of FIG. 11 for 16 reconfigurable tiles in accordance with the present disclosure.

An integrated reconfigurable electromagnetic tile 10 has radio frequency (RF) and optical layers with interconnecting RF feed lines 16 that can be placed with other reconfigurable electromagnetic tiles 10 to form a larger reconfigurable electromagnetic surface. The electromagnetic pixelated tile 10 has metallic patches 32, which have dimensions that are much smaller than a wavelength for a desired radio frequency of operation. Each metal patch 32 may be considered a pixel 32 in the electromagnetic pixelated tile 10. There are a limited number, much less than the number of pixels 32, of non-reconfigurable RF feed structures 16 which connect transmit/receive modules 12 to the pixelated surface for RF feeding of the various electromagnetic structures. An RF switch fabric has a PCM switch matrix of PCM switches 34 between the pixels 32 with an overlaying fine granulated array of sub-wavelength metallic pixels 32. The RF switches 34 allow the electromagnetic pixelated tile 10 to be reconfigured into a multitude of electromagnetic functions. The RF switches 34 can be optically actuated and reset using a VCSEL array 14. The vertical-cavity surface-emitting laser (VCSEL) array 14 has an array of semiconductor laser diodes with laser beam emissions perpendicular from the top surface, rather than conventional edge-emitting semiconductor lasers. Because VCSELs emit the beam perpendicular to the active region of the laser as opposed to parallel as with an edge emitter, an array of VCSELs can be processed simultaneously, such as on a Gallium Arsenide wafer. A control network, examples of which are shown in FIGS. 11 and 12, supplies pulsed or CW current to specific lasers in the VCSEL array 14 to reconfigure the tile 10 function. A multilayer electromagnetic bandgap structure forms a wideband multilayer ground plane 22 to cover the frequencies of operation of the pixelated tile 10.

Some advantages of present disclosure are a switch fabric with PCM switches 34 that latch so that no standby power is needed, on state resistance as low as ~0.3Ω, enabling low RF loss (~0.1 dB), fast switching—RF switch speed figure-of-merit (1/(2πRonCoff)) of 20 THz, high on/off ratio→$10^4$ which provides high isolation (~20 dB), ultra-linearity IP3~70 dBm, high power handling—10 W, and robustness—only need a passivation layer. In the prior art using semiconductor and RF MEMS switches, bias lines are required for actuation resulting in significant electromagnetic interference. RF MEMS switches and MEMS piston switches are mechanical and may require hermetic packaging for robustness, semiconductor and MEMS switches usually require constant source application, and thus standby power. Furthermore, semiconductor and some material based switches may be nonlinear under high power transmission.

The reconfigurable pixelated surface tile 30 may have reconfigurable non-driven antenna elements and other circuits between driven antenna elements of the array. Electromagnetic coupling between the driven and non-driven elements allows a grating lobe free beam scan, because the driven and coupled elements can have >λ/2 spacing. This allows reduction of T/R module count by factor of 4 or more. Reconfiguration occurs only on one surface and non-reconfigurable RF feed lines simplify integration. Sub-wavelength pixels allow frequency reconfigurability and beam scanning.

In the prior art, conventional arrays use a transmit/receive (T/R) module per radiation element for maximum scan angles. Reconfiguration of antenna elements requires reconfigurable RF feeds to prevent grating lobes. Some switch technologies may require larger pixels and thus reduce the ability to fine tune frequency or beam scanning.

The ultrafast optical actuation of the switches 34 by VCSEL array 14 has the following advantages. Laser bias lines are below the wideband multilayer ground plane 22, which shields the patches 32 from any radio frequency (RF) interference from the potentially thousands of control lines for the lasers. Energy is focused and the switches can turn on and off in ~10 ns to 100 ns, because separate heater elements with their associated thermal time constant are not required. Also, laser array actuation of the PCM switches 34 is very power efficient compared to light emitting diode (LED) actuation of photo conductive switches, which would require constant power.

In the present disclosure a wideband multilayer ground plane 22 can change the effective antenna array ground plane location with frequency, which mitigates the change in bandwidth (BW) vs. frequency. The use of a non-reconfigurable ground plane but wideband ground plane 22 simplifies integration. In the prior art, use of a single metallic ground plane causes the array bandwidth to vary with frequency. A disadvantage of a reconfigurable ground plane is that switches would be needed in the ground plane layer.

In the present disclosure, heterogeneous wafer integration may be used to form tiles with micron level control of proximity and alignment. The wafer scale integrated micro-system takes advantage of the inherent accuracy of micro-fabrication methods for patterning, bonding and thinning to construct the tiles. Parallel fabrication of sub-tiles allows independent optimization of sub-layer functions, e.g., PCM switches 34, VCSELS 14 and micro lenses 20 and 26 prior to integration. A non-integrated approach for optics would require a much larger system and more power, and a component assembly approach would not provide the alignment accuracy required to focus optical power, have higher power consumption, and would be less efficient.

FIG. 1A shows a preferred embodiment of the present disclosure. The following describes each layer in FIG. 1A, starting from the bottom of FIG. 1A.

The bottom layer has transmit/receive T/R modules 12 that condition the RF signal for transmitting and receiving. These T/R modules 12 typically consist of power amplifiers, low-noise amplifiers, mixers, phase shifters, switches, and circulators. Fewer of the T/R modules 12 are required over prior art approaches, because reconfigurability of the surface pixels 32 means that non-driven element tuning can be used to do beam steering, impedance matching, filtering, etc.

The next layer up is the array of vertical cavity surface emitting lasers (VCSELs) 14. These lasers 14 provide the controlling optical signal that actuate or reset the switches 34 between each pixel 32 of the tile 10. There are one or more lasers 14 for each pixel 32. Each VCSEL 14 has control electronics, examples of which are shown in FIGS. 11 and 12, to allow each laser 14 to independently operate at up to two different maximum power levels and have control of the shut-off waveform. The VCSEL array 14 can be obtained as a custom product from commercial vendors, for example, Princeton Optronics, Inc., 1 Electronics Drive Mercerville, N.J. 08619.

In order to focus the light from the VCSELs at the reconfigurable surface, one or more micro lens arrays are used. If more than one micro lens array is used, then the lens layers may not be contiguous and may appear at different level layers in the tile, such as shown in FIG. 1A, where a collimating lens array 20 is just above the VCSEL array 14 and a focusing lens array 26 is located just below the reconfigurable pixelated surface tile 30. Such micro lens arrays can be obtained as a custom product from commercial vendors, such as Jenoptik AG, Carl-Zeiss-Strasse 107739 Jena, Germany.

The RF non-reconfigurable ground plane 22 has small holes 23 or pin holes having a diameter much less than an RF wavelength for a desired radio frequency of operation, to allow transmission of light from the lasers 14. Since the ground plane 22 is non-reconfigurable, in order to cover a wide bandwidth, the ground plane 22 has a multiple-layer frequency selective reflector, which is well known to persons skilled in the art. A multiple-layer frequency selective reflector is a frequency selective surface and may consist of arrays of conducting elements on or between layers of dielectric substrates with band pass or band stop characteristics. Reference [1] below describes one example of such a multiple-layer frequency selective reflector, and is incorporated herein as though set forth in full. The ground plane 22 may also be connected to an overall system ground.

A substrate 24 may be between the ground plane 22 and the micro lens layer 26. The substrate should be optically transparent to allow the optical switch actuation signals to be transmitted through the substrate with minimum attenuation. The substrate 24 may be glass, fused silica, quartz, air, or other optically transparent plastics. Also, for VCSELs 14 that operate in the infrared spectrum, other substrates, such as GaAs could be used.

The pixelated surface tile 30 is the layer that consists of an arrangement of metal patches 32 and switches 34. The metal patches 32 may be various shapes including square, rectangular or octagonal, of dimension much less than a wavelength. The pixelated surface tile 30 has a substrate with the metal patches 32 and switch 34 on the substrate. The substrate for reconfigurable pixelated surface tile 30 may also be optically transparent for transmission of the optical switch actuation signals. The switches 34 are in the gaps between the patches 32, and are preferably of phase change material (PCM). These PCM switches 34 are directly above one or more VCSELS 14 such that the light from a VCSEL 14 is focused upon the PCM material 34. A close-up detail of a few patches 32 and PCM switches 34 is shown in the FIG. 1B. A metallic patch 32 plus one-half of each gap surrounding the patch 32 can be considered a pixel in the reconfigurable pixelated surface tile 30.

RF input lines 16 connect the transmit/receive module layer 12 to a patch 32 on the reconfigurable pixelated surface tile 30. The number of RF lines is dependent upon the minimum and maximum frequencies of operation, the tile size, and the resolution obtainable from the pixels. Once the number of RF lines are determined for an application, the RF input lines 16 are non-reconfigurable. An RF signal can be connected to a reconfigurable EM structure on the reconfigurable pixelated surface tile 30 by configuring a transmission line from the patch 32 to which an RF input line 16 is connected by appropriate actuation of the PCM switches 34. In addition, non-reconfigurable RF ground lines 25 may be fabricated from the RF ground plane 22 to a patch on the reconfigurable pixelated surface tile 30. These ground lines could serve as an RF ground for reconfigurable transmission line elements on the reconfigurable pixelated surface tile 30.

Further details of the component pieces of the present disclosure are described below.

The shape and the inter-pixel gap dimension for the pixels are important design parameters for the RF coupling and/or isolation between pixels 32 and the distributed PCM switch's 34 aspect ratio, which directly translates to the switch's equivalent resistance. Narrower inter-pixel gaps lead to lower required optical actuation power for the PCM switches; however, this may also result in an increase in the RF coupling that may degrade the phased array performance.

Figure 2:
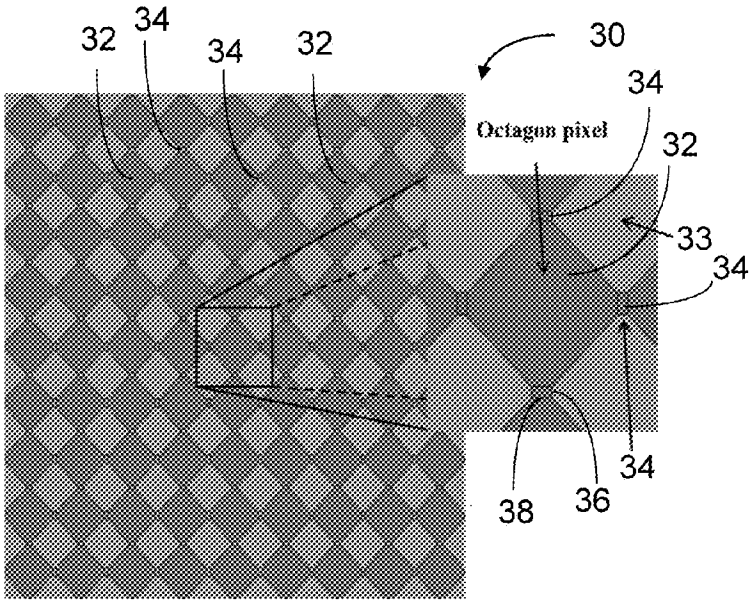
FIG. 2 shows an octagon pixel array on a face of a reconfigurable tile in accordance with the present disclosure.

An example octagonal patches 32 with spaces 33 between them and PCM switches 34 is shown in FIG. 2. The octagonal patches 32 allow narrow inter-pixel gaps between the patches 32 with an aspect ratio of 40:1, which reduces the capacitive RF coupling between pixels or patches 32. An aspect ratio of 40:1 means that the gap width 36 between the neighboring patches 32 is $1/40^{th}$ of the length 38 of the PCM switch 34 in contact with the patch 32.

The number of pixels in a tile is determined by the lowest frequency of interest, while the size of the pixel is determined by the tuning resolution needed at the high frequency end.

Figure 3:
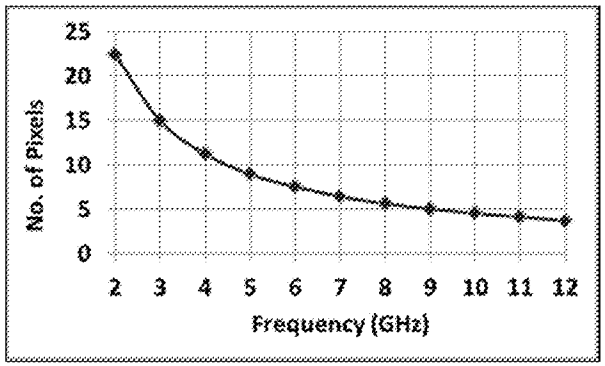
FIG. 3 shows a graph of an approximate number of pixels in the resonant length dimension for a square patch antenna in accordance with the present disclosure.

In one example, a reconfigurable surface tile with a glass substrate 24 with an array of 25×25 pixels, with each patch or pixel 32 1.5 mm square with PCM switches 34 that have a 5 μm width 36 and a 200 μm length 38, could be used to create patch antennas tunable from 2 GHz (S-band) to 12 GHz (X-band). The minimum number of pixels or patches 32 required for this example from 2 GHz (S-band) to 12 GHz (X-band) is shown in the graph of FIG. 3.

Figures 4A, 4B, 4C:
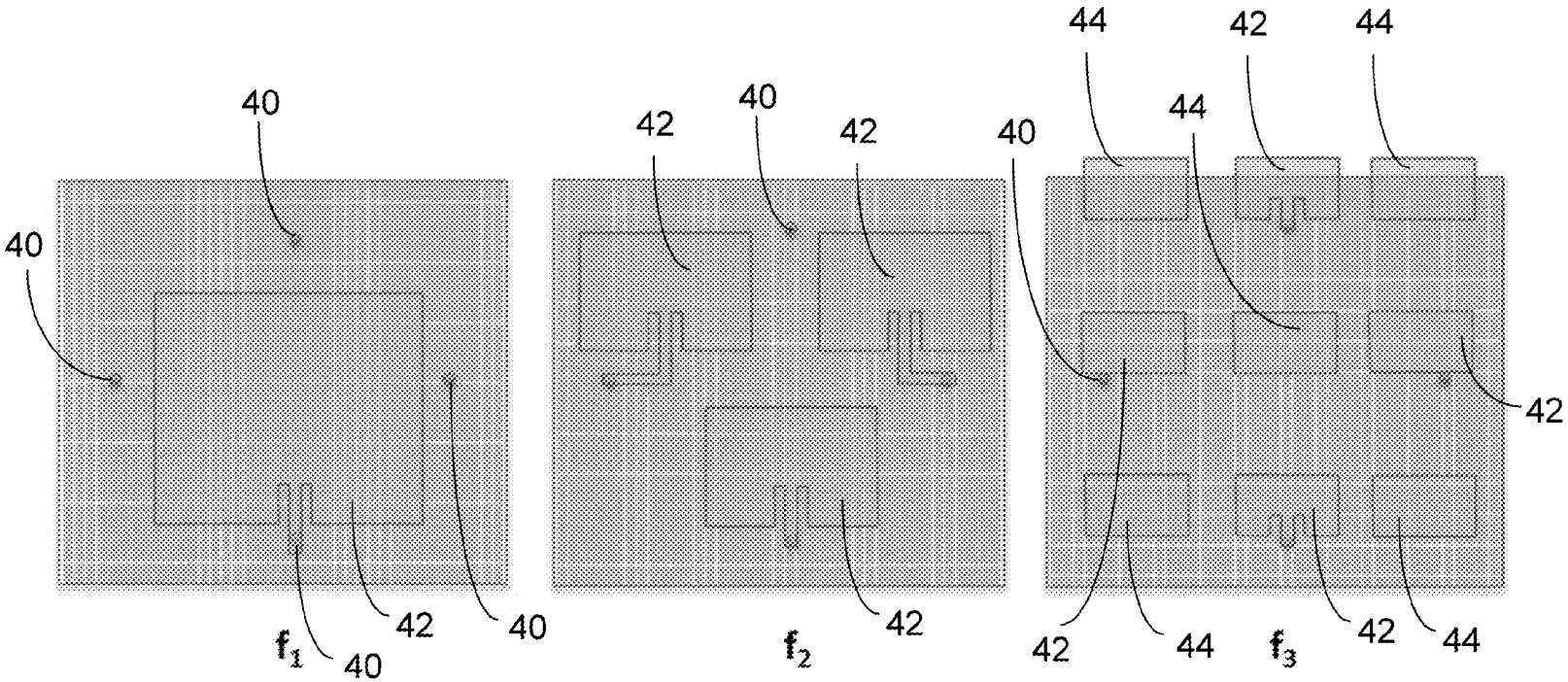
FIGS. 4A, 4B and 4C show an example of how the pixelated tile can be reconfigured to accommodate patch elements as the frequency increases from $f_1$ to $f_2$ and from $f_2$ to $f_3$ in accordance with the present disclosure.

FIGS. 4A, 4B and 4C show an example of how the patches 32 in the reconfigurable pixelated surface tile 30 can be reconfigured as the frequency increases from $f_1$ to $f_2$ and from $f_2$ to $f_3$. In FIGS. 4A, 4B and 4C, there are only 4 RF feeds points 40 located around the edges of the tile 10. Each feed point 40 may be connected to one pixel 32. In FIG. 4A for $f_1$, the PCM switches 34 are configured to form only one patch 42. In FIG. 4B for $f_2$, the PCM switches 34 are configured to form three patches 42, each one connected to an RF feed point 40. In FIG. 4C for $f_3$, the PCM switches 34 are configured to form four patches 42 and five non-driven antenna elements 44. The four patches 42 are each connected to an RF feed point 40, while the five non-driven antenna elements 44 are not connected to an RF feed point 40.

Note that at $f_3$, as shown in FIG. 4C, the top row of the 3×3 pixel array extends beyond the reconfigurable pixelated surface tile 30 into a next tile. At frequency $f_3$, electromagnetic coupling between driven patches 42 and non-driven elements 44 are used to suppress grating lobes at all scan angles, and to maintain a low VSWR.

Figure 5A:
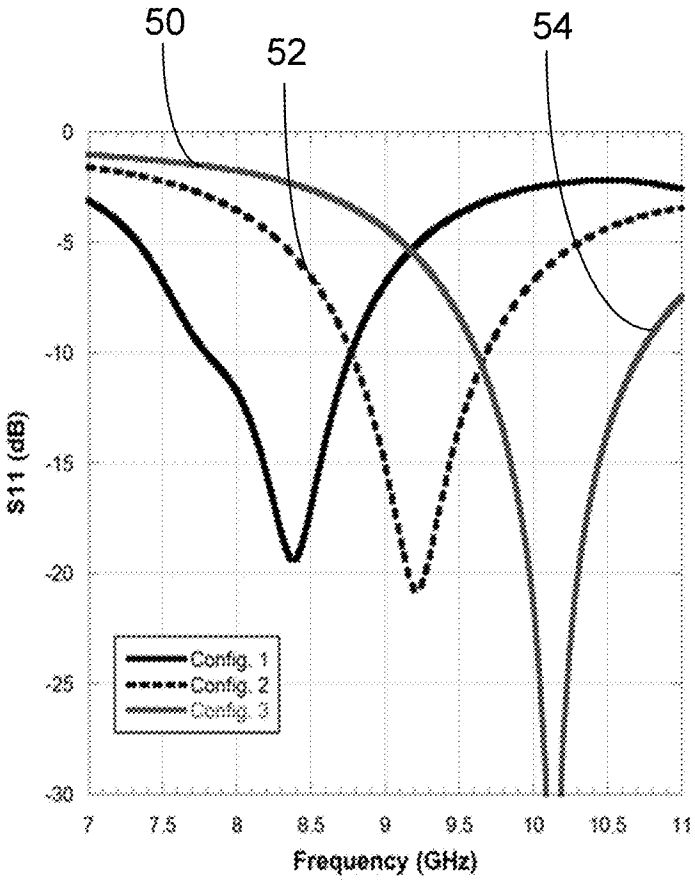
FIG. 5A shows the reflection coefficient into the antenna for simulations of a pixelated tile configured as a patch antenna and then reconfigured in size to three different operational frequencies centered at 8.38, 9.2, and 10.1 GHz.
Figure 5B:
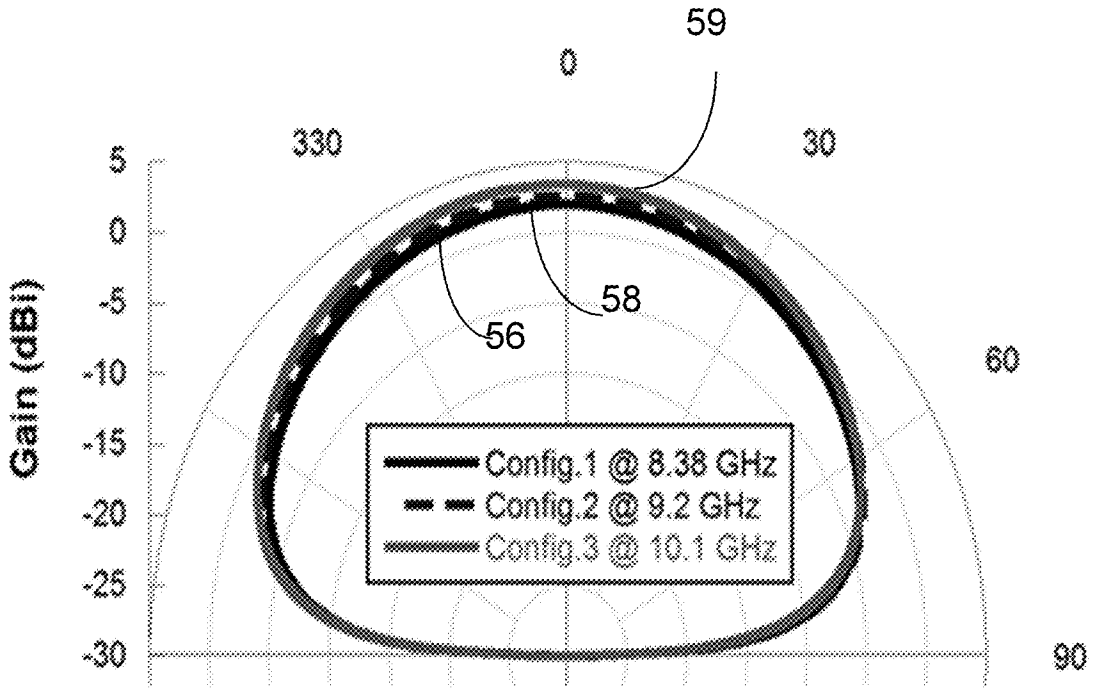
FIG. 5B shows the corresponding antenna patterns in accordance with the present disclosure.

In FIG. 5A, a single pixelated patch antenna was simulated to be reconfigured for operation at frequencies 8.38, 9.2 and 10.1 GHz through three transformations of the switches 34 to change the antenna patch geometry. A single fixed RF feed point was used. FIG. 5A shows graphs 50, 52 and 54 for the reflection coefficient $S_{11}$ into the antenna for the three configurations. FIG. 5B shows the far-field patterns 56, 58 and 59 for the three configurations. The PCM switch 34 on and off sheet resistances were assumed to be 100 Ω/square and 1000 kΩ/square.

In the configuration of FIG. 5B centered at 10.1 GHz, the simulated efficiency is approximately 80% of that of a nonreconfigurable antenna with the same geometry. 10% of the difference in the efficiency is mainly due to the RF loss contributed by the PCM switches 34 interconnecting the patches or pixels 32. Other types of planar antennas can also be configured with a reconfigurable pixelated surface tile 30, such as dipole, bow-tie, fragmented, and fractal antennas.

As discussed above with reference to FIG. 1A, the ground plane 22 is not reconfigurable. Because the optimum performance of the EM structure, such as impedance match and radiation gain, depends upon the thickness between the structure and the ground plane, it is necessary that this effective difference varies as the operational frequency changes. This can be accomplished by using multiple levels of frequency selective surfaces for the ground plane 22, which are described in Reference [1] below.

The phase change material (PCM) switches 34 have a known property that if the PCM material is heated to one temperature, approximately 300° C. and cooled in a controlled manner, the material will crystallize and become conductive. If the PCM material is heated to a higher temperature, approximately 700° C., and then rapidly quenched it will become amorphous and non-conducting. Thus the switches 34 in the pixelated surface can be actuated and reset by this temperature control. The preferred PCM switch 34 for this present disclosure is fabricated from germanium-telluride (GeTe) doped chalcogenide glass. Chalcogenide glass a glass containing one or more chalcogenide elements. Chalcogenide compounds are widely used in rewritable optical disks and phase-change memory devices and by applying heat, they can be switched between an amorphous and a crystalline state, thereby changing their optical and electrical properties and allowing the storage of information. An application for phase change material is further described in U.S. patent application Ser. No. 13/737,441, filed Jan. 9, 2013, which is incorporated herein as though set forth in full.

The PCM material 34 is fabricated to lie within the gaps of the metallic patches 32 such that when actuated into the on state, the switch 34 would provide a low resistance bridge between two patches, thus effectively connecting them electrically. In this way, actuation of particular patterns of switches 34 by combining various pixels or patches 32 is what creates the reconfigurable planar EM structures such as antennas, transmission lines, or frequency selective surfaces.

Figure 6A:
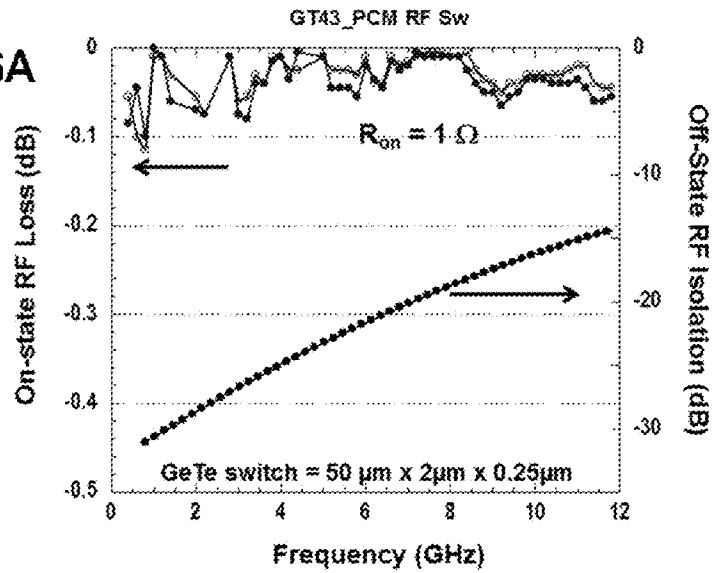
FIG. 6A shows a measured radio frequency (RF) loss of GeTe switches up to 12 GHz.
Figure 6B:
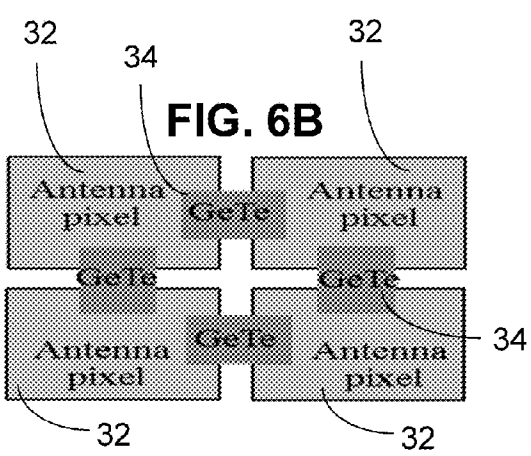
FIG. 6B shows 4 switches connecting 4 pixels.
Figure 6D:
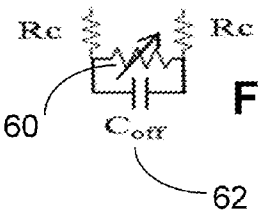
FIG. 6D shows a simple equivalent circuit model of GeTe RF switches with PCM resistance and $C_{off}$ in parallel in accordance with the present disclosure.

An example of how the PCM switches 34 is placed in the gaps between the metallic patches 32 is shown in FIG. 6B. FIG. 6D shows a simple equivalent circuit model of a GeTe PCM switch 34 with a resistor 60 and a capacitor $C_{off}$ 62 in parallel.

Figure 6C:
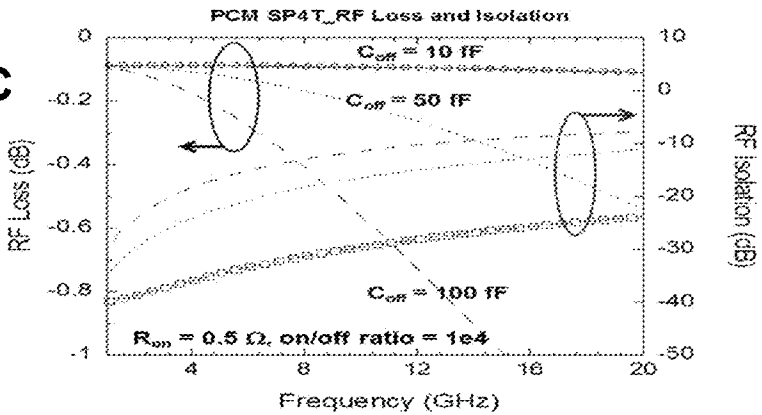
FIG. 6C shows simulated single pole four throw (SP4T) RF switches in terms of different $C_{off}$ with $R_{on}$ of 0.5Ω and $R_{off}/R_{on}$ ratio of $10^4$.

FIG. 6A shows the measured RF insertion loss for a GeTe PCM switch 34 up to 12 GHz. The insertion loss is ~0.1 dB up to 12 GHz with an on-state resistance, $R_{on}$ of 1Ω. FIG. 6C shows the simulated insertion loss and isolation for an example GeTe SP4T switch 34. An insertion loss of <0.1 dB is feasible with $R_{on}$ of <0.5Ω, and $R_{off}/R_{on}$ ratio of $10^4$. This low level of on-state resistance is feasible using a PCM switch 34 with a geometry of 5 μm in width 36 and 200 to 400 μm in length 38. Such a switch 34 is compatible with VCSEL actuation. With an off-state capacitance $C_{off}$ of 10 fF, the RF isolation can be maintained as high as 25 dB.

Figure 7A:
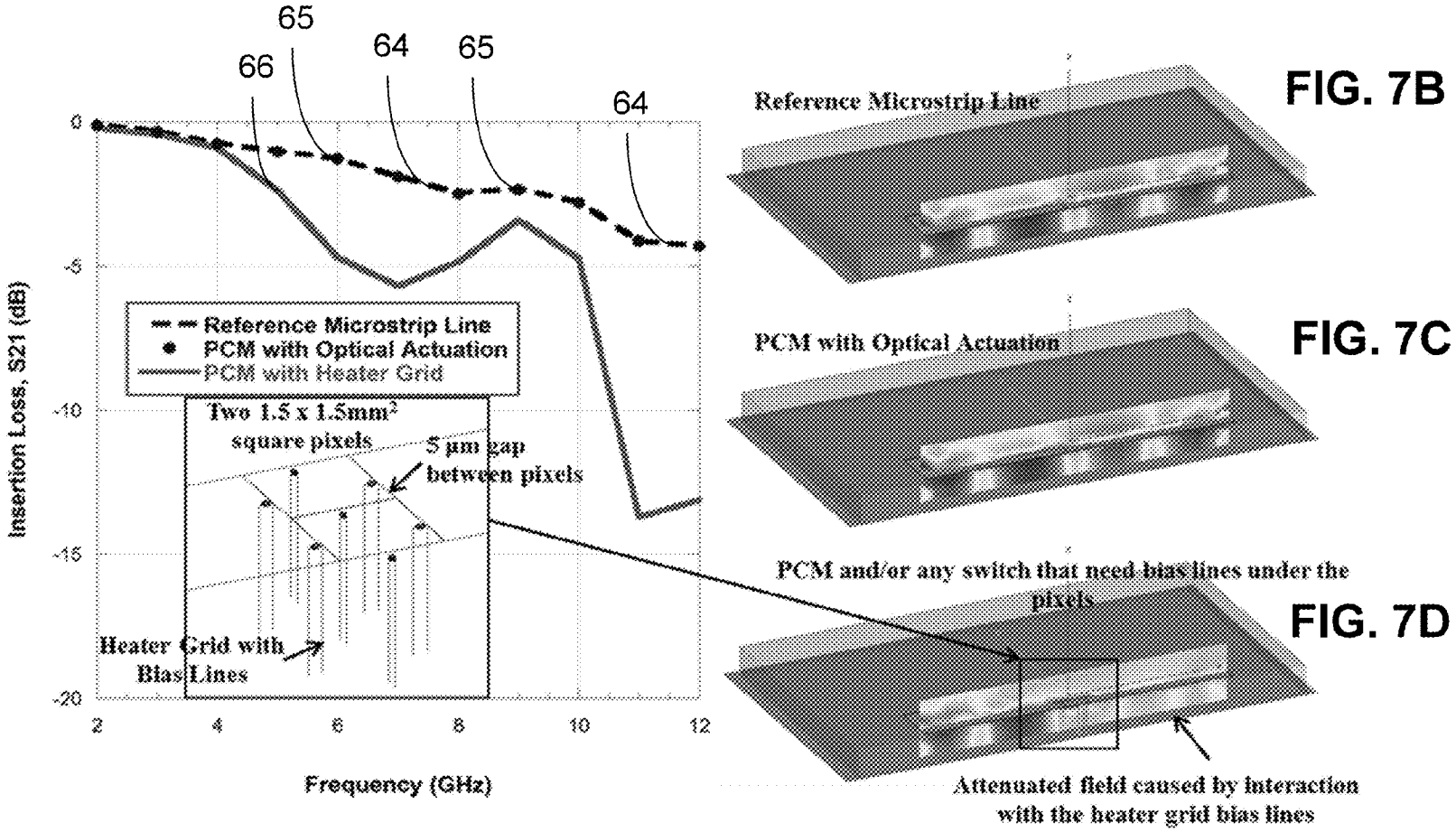

The PCM switches 34 can be actuated by placing small heating elements near the switch instead of using optical actuation. However, the bias network for the heating elements would seriously degrade the RF performance of the reconfigurable EM structure. This can be seen in FIG. 7A, which shows the results 64, 65 and 66 for a simulation of the reference microstrip line of FIG. 7B, the PCM switch with optical actuation of FIG. 7C, and the PCM switch with bias lines for heating of FIG. 7D, respectively. A 2-mm-thick glass substrate having a dielectric constant ($\in_r$) of 5.5 was used for the simulation. The simulation demonstrates the significant degradation in RF performance for two pixels with a gap of 5 μm between two identical 10 mm long microstrip lines. In the simulation, the PCM switches 34 had an on-state sheet resistance of 100 ohms/square. For the case of the switches requiring the bias lines, as shown in FIG. 7C, the electromagnetic model includes wire lines with a resistor representing a heater grid below each PCM switch locations. Comparison of the insertion loss S21 parameter of the configuration of FIG. 7D clearly shows that the RF transmission along the microstrip line starts to degrade at 2 GHz and becomes huge toward the higher frequencies in the presence of the bias lines, whereas the case with no bias lines, as shown in FIG. 7C, which is the optical actuation approach of the present disclosure, shows no degradation in the RF performance in comparison to the reference microstrip line shown in FIG. 7B. The near-field plots along the microstrip line, as shown in FIGS. 7A, 7B and 7C, also clearly demonstrate the attenuated electromagnetic fields in FIG. 7D compared to FIGS. 7B and 7C. The attenuated electromagnetic fields in FIG. 7D are caused by the bias lines below the pixels.

The optical actuation of this disclosure eliminates the need for bias lines for heater grids. Optical actuation of the PCM switches 34 starts from a corresponding array of focused high power vertical cavity surface emitting lasers (VCSEL) 14, as shown in FIG. 1A. Optical actuation of phase change material (PCM) is already used for consumer rewritable DVDs (DVD+RW) and Blue-Ray disks for dynamic optical storage, and as such, is a fairly mature technology, which is described in References [2] and [3] below. In these applications, pulsed red (650 to 660 nm) and UV-blue (400 to 450 nm) laser diodes with focused diffraction-limited spots (0.4 to 0.6 μm) are used to actuate the PCM material in DVD and Blue-Ray disks, respectively, and change its optical reflectivity for readout. The corresponding write and erase optical power densities are on the order of 15 to 30 mW/μm$^2$ for 10 to 50 ns pulse durations. For DVDs, a single laser is used and the DVD is rotated mechanically while the laser moves radially along the DVD to perform the read and write functions. In the original state, the recording layer of a DVD is polycrystalline. During writing a focused laser beam selectively heat areas of phase change material above the melting temperature, so that all the atoms in the area can move rapidly to a liquid state. Then, when cooled, the random liquid state is "frozen in" and the so-called amorphous state is obtained. If the phase change layer is heated below the melting temperature but above the crystalline temperature for a sufficient time, the atoms revert back to an ordered state, i.e. the crystalline state.

In the present disclosure, there is an array of lasers 14 such that each PCM switch 34 is in a one-to-one correspondence with a laser. Vertical cavity surface emitting lasers (VCSELs) 14 are preferred for actuating the switches 34 because they can transmit an optical beam 18, as shown in FIG. 1A, normal to their substrate surface. VCSELs 14 have high power conversion efficiencies of greater than 40%, and are inherently capable of being arranged in a customized two-dimensional (2D) array format. The VCSEL array, in conjunction with a matching microlens array, can have a sufficient optical power density to controllably change the phase, and hence the electrical resistance, of the PCM switches 34 in the antenna array. High-power VCSEL arrays are also a fairly mature technology.

Figure 8A:
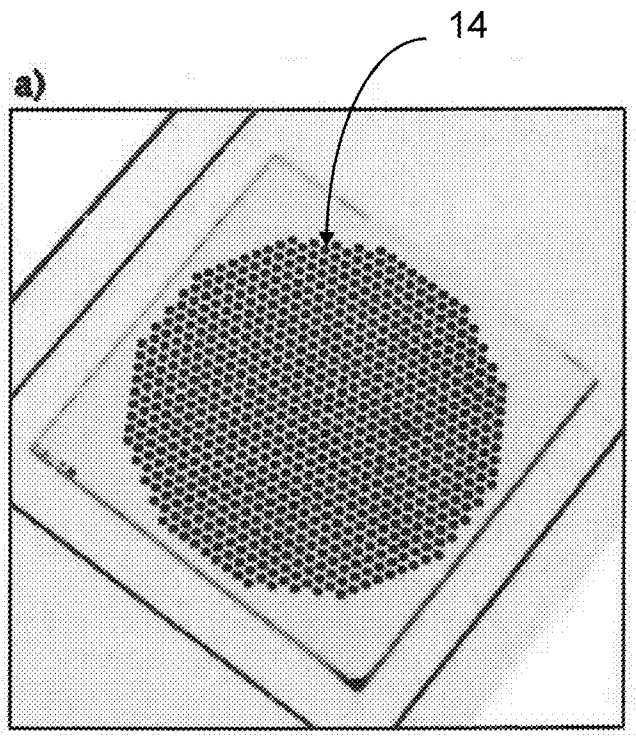
FIG. 8A PRIOR ART
FIG. 8A shows a layout of an array of multi-mode vertical cavity surface emitting lasers (VCSELs) and FIG. 8B shows an output optical power and power conversion efficiency in accordance with the prior art.
Figure 8B:
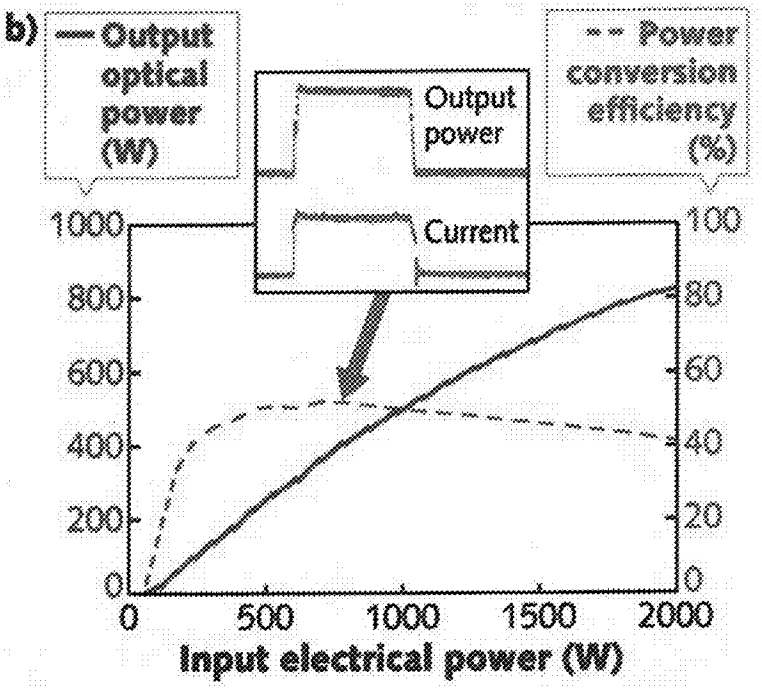
FIG. 8B PRIOR ART

FIG. 8A shows a layout of a 2D (two dimensional) array of multi-mode VCSELs 14, which may have a wavelength of 976 nm. Such an array is described in Reference [4] below. FIG. 8B shows the output optical power and power conversion efficiency for an array of multi-mode VCSELs 14 delivering a pulse peak power of 800 W and a power conversion efficiency of 40% at 976 nm wavelength. The VCSEL array may be driven by a current pulse waveform with a 250 μs pulse width and about 1 A peak current for each VCSEL. A peak output power of about 1 W can be obtained with multi-mode VCSELs 14 having an emitting aperture of 50 μm and driven with 1 μs or wider current pulse waveforms. Decreasing the current pulse width to about 200 ns can result in an output amplitude about 5 times that for a 1 μs current pulse width.

The high peak output power of the pulsed multi-mode VCSELs 14 can be used to heat the PCM material segment 34 between each radiating patch 32 of the reconfigurable pixelated surface tile 30 and hence switch its phase and electrical resistance. For GeTe-based PMC material 34, a power density of about 2 mW/μm$^2$ at a pulse width of 700 ns is required to change its initial amorphous phase into polycrystalline, as described in References [5], [6] and [7] below, resulting in more than three orders of magnitude reduction in its electrical resistivity. A power density of about twice this value is required to reverse the PCM 34 to its amorphous phase. These optical power density levels increase as the pulse width is decreased. For example, power densities on the order of 15 to 30 mW/μm$^2$ at 10 to 50 ns pulse widths are currently used for DVD write and erase cycles.

Figure 9:
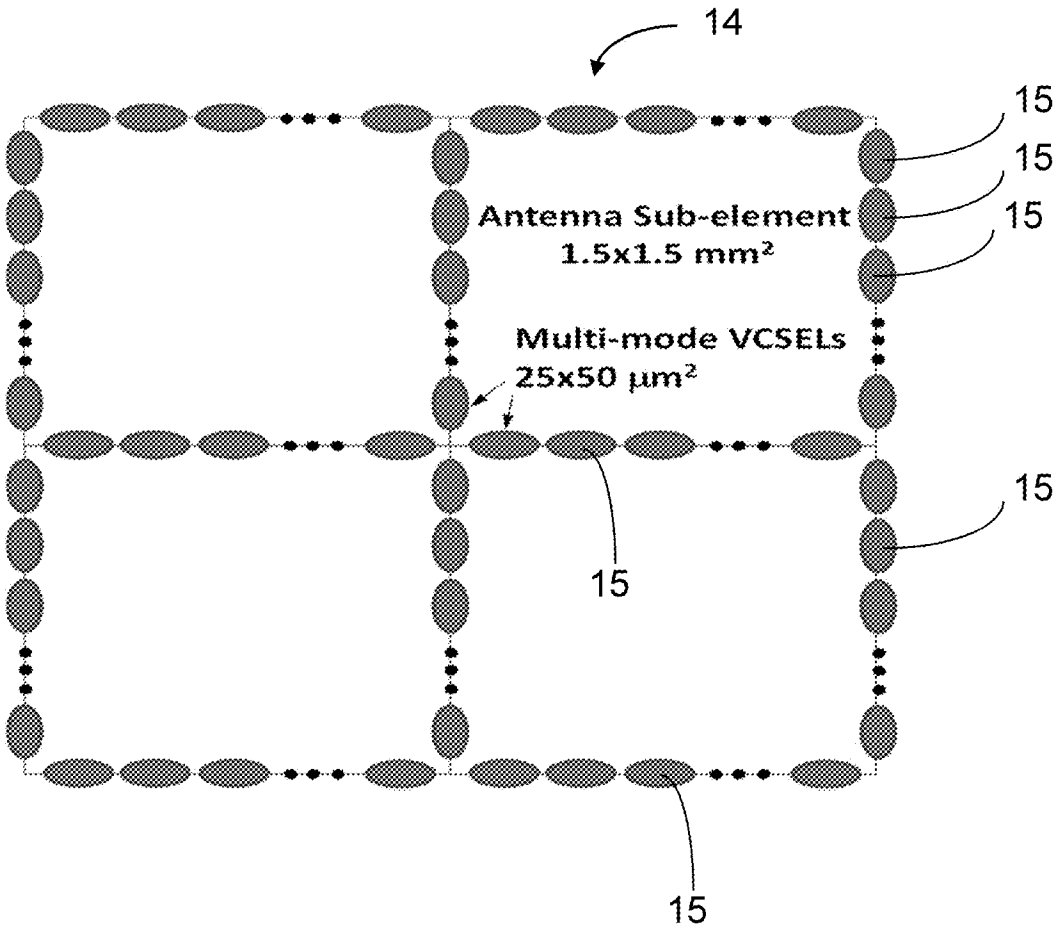
FIG. 9 shows a plan view of a VCSEL array layout that may be used to actuate PCM switches around four pixels in accordance with the present disclosure.

In order to get enough optical power to create a high enough temperature in a given PCM switch 34 to set or reset the switch state, it may be necessary to focus each optical beam 18 to a small spot on that PCM switch 34, which can be performed using a focusing micro-lens array. Multiple VCSELs 14 may be used to actuate a single PCM switch by using multiple multi-mode VCSELs 15 in a linear segment, as shown in FIG. 9. FIG. 9 shows a plan view of the VCSEL array layout 14 that may be used to actuate PCM switches around four pixels. In FIG. 9, the VCSEL layout 14 follows the grid of gaps between patches 32 in the reconfigurable pixelated surface tile 30. Each of the linear segments shown in FIG. 9 consists of a linear arrangement of oval-shaped, multi-mode VCSELs 15 with dimensions that can range from 25 to 50 μm along the short axis, and from 50 to 100 μm along the long axis, with a gap of 5 to 10 μm between consecutive emitting elements 15.

Figure 10:
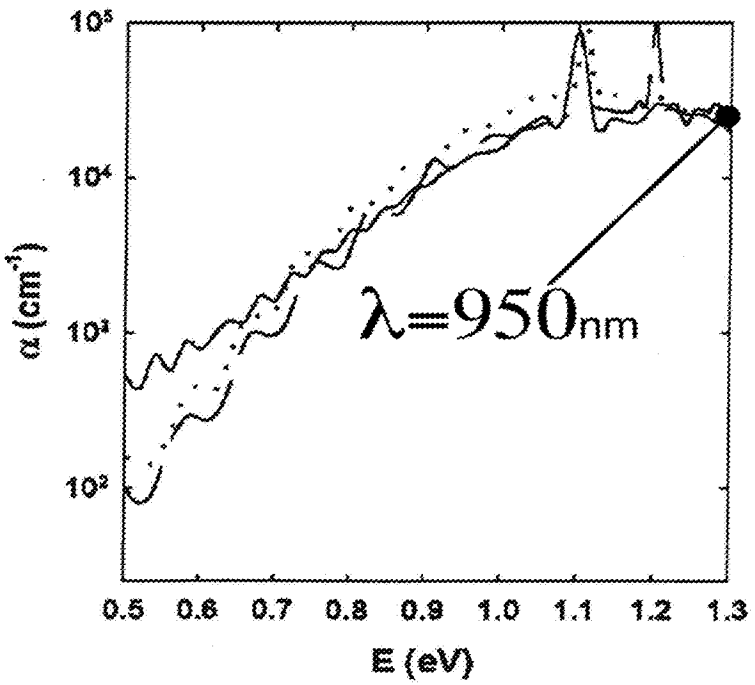
FIG. 10 PRIOR ART
FIG. 10 shows an absorption spectrum of GeTe PCM material showing an absorption depth of 300 to 500 nm at wavelengths of 950 to 980 nm in accordance with the prior art.

VCSELs 14 are most efficient at wavelengths longer than 950 nm because of the optical gain achievable in the quantum-well structures used. Fortunately, light emitted in the wavelength range of 950 to 980 nm is within the absorption band of the GeTe PCM material, as shown in FIG. 10. The absorption coefficient at 950 to 980 nm wavelengths (1.27 to 1.31 eV) is about 2 to $3\times10^4$ cm$^{-1}$, as described in Reference [5] below, resulting in an absorption depth of about 300 to 500 nm.

In order to concentrate the output power of the multi-mode VCSEL array 14 onto the PCM switch array 34, a set of two custom-designed microlens arrays is placed in between the VCSELs 14 and the reconfigurable pixelated surface tile 30, as shown in FIG. 1A. The first microlens array 20 is placed close to the VCSEL array 14 at its focal length in order to collimate the diverging light emitted from the VCSELs 14. The focusing microlens array 26, positioned close to the reconfigurable pixelated surface tile 30, focuses the collimated light beams emanating from the first set of microlenses 20 onto the corresponding PCM switches 34 in between the metallic patches 32. A focusing microlens 26 diameter and focal length of 50 μm and 100 μm, respectively (f–number=2), for example, results in a spot size $d_0$ of about 4 μm on the PCM switch at 1 μm wavelength ($d_0=2f\lambda/D$, where f is the focal length and D is the aperture of the microlens. This spot size corresponds well with the 5 μm width 36 of the PCM switch 34 in the example layout of FIG. 2.

Using the microlens design to focus each 25 μm aperture VCSEL 14 with a peak output power of about 1 W driven at a pulse width of 200 ns or less, may result in an optical power density of more than 50 mW/μm$^2$ incident on the PCM switch 34. This power density level is more than enough to switch the phase of the PMC even at shorter pulse widths. The electrical resistivity of GeTe PCM material is typically about $3\times10^{-6}$ Ω·m in the polycrystalline phase, and 4 to 5 orders of magnitude higher in its amorphous phase, as described in U.S. patent application Ser. No. 13/737,441, filed Jan. 9, 2013. For a PCM thickness of 500 nm, which is within the absorption depth of 950 nm wavelength light, the electrical resistance of a 5×10 μm$^2$ crystallized segment formed by a focused 25×50 μm$^2$ multi-mode VCSEL element 14 is about 3Ω. Multiple lasers 15, as shown in FIG. 9, focusing along a single PCM switch 34 would lower the resistance by the number of lasers 15.

The VCSEL arrays 14 used to optically activate the PCM switches 34 in each reconfigurable pixelated surface tile 30 require appropriate control and drive electronic circuitry. An example of a laser driver switch matrix system sufficient to provide current pulse outputs to 1250 VCSELS 14 within 1 milliseconds is shown in FIG. 11. The VCSELs 14 may be grouped into blocks of 125 units, each to be addressed in parallel. Each unit will require: a laser driver 70 with on/off control, pulse width control, and current level control; and a 1:125 high-speed switch matrix 78 capable of directing the laser driver output sequentially to 125 positions in the tile. The laser drive circuit 70 has ten laser driver/switch matrix subsystems, associated buffers and a field programmable gate array (FPGA) control 72 to facilitate simultaneous operation of the ten laser drivers in parallel, with individual laser driver configuration control. The relative output position from each switch matrix 78 will be the same for each of the ten laser units in the tile, as the switch matrices are driven in parallel through 1:10 distribution buffers 76 and FPGA control 74. Thus, 125 FPGA outputs may be applied to 1250 switches 34. Ten 10 FPGA control lines 73 are required for laser on/off control and 10 FPGA lines 75 are required for laser driver current control. One FPGA line 77 is required to set all laser drivers to either slow or fast.

An example of an extension of this approach to a larger tile or to multiple tiles is shown in FIG. 12. In this example, the network drives 16 pixelated tiles, each with 1250 VCSELs. This extension is done simply by inserting 1:16 distribution buffers 76 and switch matrices 78, as shown in FIG. 12. The FPGA control mechanism is the same as in the single tile example of FIG. 11, with 125 switch control and 21 laser driver control lines required. It would be obvious to one skilled in the art to modify this network for other numbers of VCSELs to be controlled within a pixelated tile.

References [1]-[7] below are incorporated herein as though set forth in full.

[1]. Su, T.; Li, C. Y.; He, M.; Chen, R. S., "A numerically efficient transmission characteristics analysis of finite planar Frequency-Selective Surfaces embedded in stratified medium," *Microwave and Millimeter Wave Technology* (*ICMMT*), 2010 *International Conference on*, vol., no., pp. 152, 155, 8-11 May 2010.

[2]. DVD+Rewritable—"How it works", Philips Media Relations, 1999, Einhoven, The Netherlands.

[3]. D. J. Adelerhol, "Media Development for DVD+RW Phase Change Recording", Proc. European Symposium on Phase Change Material (epcos.org), 2004.

[4]. J. F. Sevrin, R. Van Leevwen and C. Ghosh, "High Power VCSELs Mature into Production", Laser Focus World, April 2011 page 61.

[5]. J. K. Olson et al., "Optical properties of amorphous GeTe, $Sb_2Te_3$, $Ge_2Sb_2Te_5$: The role of oxygen", Journal of Applied Physics, vol. 99, p. 103508, 2006.

[6]. C. H. Chu et al., "Laser-induced phase transition of $Ge_2Sb_2Te_5$ thin films used in optical and electronic data storage and in thermal lithography", Optics Express, vol. 17, p. 18383, 2010.

[7]. M. Xu et al., "Pressure tunes electrical resistivity by four orders of magnitude in amorphous $Ge_2Sb_2Te_5$ phase-change memory alloy", Proceeding National Academy Science USA. 2012 May 1; 109(18): E1055-E1062.

Having now described the present disclosure in accordance with the requirements of the patent statutes, those skilled in this art will understand how to make changes and modifications to the present invention to meet their specific requirements or conditions. Such changes and modifications may be made without departing from the scope and spirit of the present disclosure as disclosed herein.

The foregoing Detailed Description of exemplary and preferred embodiments is presented for purposes of illustration and disclosure in accordance with the requirements of the law. It is not intended to be exhaustive nor to limit the present disclosure to the precise form(s) described, but only to enable others skilled in the art to understand how the present disclosure may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the present disclosure be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . ."

What is claimed is:

1. A reconfigurable electro-magnetic tile comprising:

a laser layer comprising a plurality of lasers, wherein the laser layer has a height;

a pixelated surface comprising a plurality of metal patches and a plurality of switches, wherein each respective switch of the plurality of switches is in a gap between a first respective metal patch and a second respective metal patch; and a ground plane between the laser layer and the pixelated surface, wherein the ground plane is above the laser layer and does not intersect any portion of the height of the laser layer, wherein the ground plane comprises a frequency selective surface, wherein the ground plane has a plurality of pin holes, each pin hole extending entirely through the ground plane, wherein each respective pin hole allows light from at least one respective laser of the plurality of lasers to be transmitted through the ground plane to a respective switch, and wherein at least one respective laser of the plurality of lasers transmits light that passes through at least one respective pin hole;

wherein each respective switch is optically coupled to at least one respective laser of the plurality of lasers;

wherein each switch of the plurality of switches comprises a phase change material;

wherein the phase change material of a respective switch changes from a non-conducting state to a conducting state when the coupled respective laser lases a first power density of light on the phase change material of the respective switch; and wherein the phase change material of a respective switch changes from a conducting state to a non-conducting state when the coupled respective laser lases a second power density of light on the phase change material of the respective switch.

2. The reconfigurable electro-magnetic tile of claim 1 wherein:

the plurality of lasers comprise a plurality of vertical cavity surface emitting lasers (VCSELs).

3. The reconfigurable electro-magnetic tile of claim 1 further comprising:

a plurality of lenses between the laser layer and the pixelated surface;

wherein each respective lens of the plurality of lenses focuses light from a respective laser onto a respective switch.

4. The reconfigurable electro-magnetic tile of claim 3 wherein the plurality of lenses further comprise:

a collimating lens array comprising a first plurality of micro-lenses between the laser layer and the ground plane; and a focusing lens array comprising a second plurality of micro-lenses between the ground plane and the pixelated surface.

5. The reconfigurable electro-magnetic tile of claim 4 further comprising:

an optically transparent substrate between the ground plane and the focusing lens array;

wherein the optically transparent substrate comprises glass, fused silica, quartz, an optically transparent plastic, or GaAs.

6. The reconfigurable electro-magnetic tile of claim 1:

wherein the ground plane shields the pixelated surface from radio frequency interference from control lines for the plurality of lasers.

7. The reconfigurable electro-magnetic tile of claim 1 further comprising:

a plurality of transmit/receive modules, each transmit/receive module coupled by an electrical conductor to at least one metal patch of the plurality of metal patches;

wherein the laser layer is between the plurality of transmit/receive modules and the pixelated surface.

8. The reconfigurable electro-magnetic tile of claim 1 wherein the phase change material comprises:

germanium-telluride (GeTe) doped chalcogenide glass.

9. The reconfigurable electro-magnetic tile of claim 1 wherein the ground plane comprises:

a multiple-layer frequency selective reflector.

10. The reconfigurable electro-magnetic tile of claim 1 wherein the phase change material has an aspect ratio such that a width of the phase change material across the gap is substantially less than a length of the phase change material along the gap.

11. The reconfigurable electro-magnetic tile of claim 1 further comprising:

a control and driver circuit for controlling and selectively driving lasers of the plurality of lasers.

12. The reconfigurable electro-magnetic tile of claim 1 wherein the pixelated surface further comprises:

reconfigurable non-driven elements.

13. The reconfigurable electro-magnetic tile of claim 1 wherein:

the metallic patches have dimensions smaller than a wavelength for a desired radio frequency of operation.

14. The reconfigurable electro-magnetic tile of claim 1 wherein a diameter of each pin hole is less than a wavelength for a desired radio frequency of operation.

15. A method of providing a reconfigurable electro-magnetic tile comprising:

providing a laser layer comprising a plurality of lasers, wherein the laser layer has a height;

providing a pixelated surface comprising a plurality of metal patches and a plurality of switches, wherein each respective switch of the plurality of switches is in a gap between a first respective metal patch and a second respective metal patch; and providing a ground plane between the laser layer and the pixelated surface, wherein the ground plane is above the laser layer and does not intersect any portion of the height of the laser layer, wherein the ground plane comprises a frequency selective surface, wherein the ground plane has a plurality of pin holes, each pin hole extending entirely through the ground plane, wherein each respective pin hole allows light from at least one respective laser of the plurality of lasers to be transmitted through the ground plane to a respective switch, and wherein at least one respective laser of the plurality of lasers transmits light that passes through at least one respective pin hole;

wherein each respective switch is optically coupled to at least one respective laser of the plurality of lasers;

wherein each switch of the plurality of switches comprises a phase change material;

wherein the phase change material of a respective switch changes from a non-conducting state to a conducting state when the coupled respective laser lases a first power density of light on the phase change material of the respective switch; and wherein the phase change material of a respective switch changes from a conducting state to a non-conducting state when the coupled respective laser lases a second power density of light on the phase change material of the respective switch.

16. The method of claim 15 wherein:

the plurality of lasers comprise a plurality of vertical cavity surface emitting lasers (VCSELs).

17. The method of claim 15 further comprising:

providing a plurality of lenses between the laser layer and the pixelated surface;

wherein each respective lens of the plurality of lenses focuses light from a respective laser onto a respective switch.

18. The method of claim 17 wherein the plurality of lenses further comprise:

a collimating lens array comprising a first plurality of micro-lenses between the laser layer and the ground plane; and a focusing lens array comprising a second plurality of micro-lenses between the ground plane and the pixelated surface.

19. The method of claim 18 further comprising:

providing an optically transparent substrate between the ground plane and the focusing lens array;

wherein the optically transparent substrate comprises glass, fused silica, quartz, an optically transparent plastic, or GaAs.

20. The method of claim 15:

wherein the ground plane shields the pixelated surface from radio frequency interference from control lines for the plurality of lasers.

21. The method of claim 15 further comprising:

providing a plurality of transmit/receive modules, each transmit/receive module coupled by an electrical conductor to at least one metal patch of the plurality of metal patches;

wherein the laser layer is between the plurality of transmit/receive modules and the pixelated surface.

22. The method of claim 15 wherein the phase change material comprises:

germanium-telluride (GeTe) doped chalcogenide glass.

23. The method of claim 15 wherein the ground plane comprises:

a multiple-layer frequency selective reflector.

24. The method of claim 15 wherein the phase change material has an aspect ratio such that a width of the phase change material across the gap is substantially less than a length of the phase change material along the gap.

25. The method of claim 15 further comprising:

providing a control and driver circuit for controlling and selectively driving lasers of the plurality of lasers.

26. The method of claim 15 wherein the pixelated surface further comprises:

reconfigurable non-driven elements.

27. The method of claim 15 wherein:

the metallic patches have dimensions smaller than a wavelength for a desired radio frequency of operation.

28. The method of claim 15 further comprising:

reconfiguring the pixelated surface by setting a first plurality of the switches to a non-conducting state, and setting a second plurality of the switches to a conducting state;

where a non-conductive state is a state of substantially higher impedance than a conductive state.

29. The reconfigurable electro-magnetic tile of claim 15 wherein a diameter of each pin hole is less than a wavelength for a desired radio frequency of operation.

* * * * *